US005615890A

United States Patent [19]

Blue

[11] Patent Number: 5,615,890

[45] Date of Patent: Apr. 1, 1997

[54] NO BOUNCE NO DUNK RECREATION BALL GAME

[76] Inventor: John D. Blue, P.O. Box 1992, Tarpon Springs, Fla. 34688-1992

[21] Appl. No.: 648,726

[22] Filed: May 16, 1996

[51] Int. Cl.[6] ..... A63B 67/00

[52] U.S. Cl. ..... 473/469; 473/474; 473/518; 473/613

[58] Field of Search ..... 273/411, 1.5 R, 273/1.5 A, 400, 401, 402, 395, 396, 398

[56] References Cited

U.S. PATENT DOCUMENTS

| | | | |
|---|---|---|---|
| 3,201,126 | 8/1965 | Nissen | 273/402 X |
| 3,671,040 | 6/1972 | Meyer et al. | 273/342 X |
| 3,817,520 | 6/1974 | Burgos | 273/411 X |
| 3,880,427 | 4/1975 | Bingham | 273/402 X |
| 3,908,994 | 9/1975 | Astrom | 273/61 R |
| 3,968,968 | 7/1976 | Peterson | 273/411 |
| 4,047,717 | 9/1977 | De Angelis | 273/411 X |
| 4,231,572 | 11/1980 | Thornton | 273/402 X |
| 4,415,154 | 11/1983 | Engelhardt | 273/26 A |
| 4,457,513 | 7/1984 | Thompson | 273/411 |
| 4,463,951 | 8/1984 | Kumasaka et al. | 273/58 |
| 4,497,492 | 2/1985 | Lehman, Jr. et al. | 273/411 |
| 4,523,762 | 6/1985 | Garner, Sr. | 273/411 |
| 4,643,433 | 2/1987 | Wehby | 273/402 |
| 4,762,319 | 8/1988 | Krumholz | 273/402 X |
| 4,807,879 | 2/1989 | Eliot | 273/29 A |
| 4,844,478 | 7/1989 | Kessler | 273/411 |
| 4,874,169 | 10/1989 | Litchfield | 273/60 R |
| 4,993,709 | 2/1991 | Tominaga | 273/29 A |
| 5,072,947 | 12/1991 | Blue | 273/371 |

FOREIGN PATENT DOCUMENTS

| | | | |
|---|---|---|---|
| 428951 | 4/1911 | France | 273/58 X |

*Primary Examiner*—William H. Grieb

[57] ABSTRACT

A competitive recreational game including: a foam game ball with symmetrical air holes therethrough; at least one paddle, racquet or mitt per player; a vertical net attached to a frame with support posts; a ball return to player net for each opposing player; at least one opposing basketball hoop with attached net to at least one common backboard on the forehand and backhand side; a central located basketball hoop attached to the top center portion of the vertical frame common to both players and a playing court with boundaries, scoring rules and regulations for all level of play based on at least 1 opposing player. Points are scored by subtracting from 15 down to zero in several strategic rewarding ways. The AIR BALL game is NO BOUNCE NO DUNKING and designed to be played on the beach, in the backyard or indoors on a floor surface. A one person practice board, with post and base, a hoop with net and a ball return to player net, designed to warm-up touch and accuracy, is also part or an extension of this recreation game.

9 Claims, 7 Drawing Sheets

NO BOUNCE NO DUNK RECREATION BALL GAME

FIELD OF THE INVENTION

This invention relates generally to a game apparatus with a foam air ball which is hit back and forth across a supported net on posts between at least 2 players on a defined playing court.

PRIOR ART DESCRIPTION

Competitive games of various types are numerous such as badminton, tennis and racquetball. These games range from 1 to 2 or more opposing players (singles or doubles). An extensive search was done for the granted patent aforementioned U.S. Pat. No. 5,072,947. The search revealed the following prior art patents : U.S. Pat. No. 3,968,968; U.S. Pat. No. 4,457,513; U.S. Pat. No. 4,844,478; U.S. Pat. No. 3,908,994; U.S. Pat. No. 3,817,520; U.S. Pat. No. 4,523,762; U.S. Pat. No. 4,415,154; U.S. Pat. No. 4,047,717; U.S. Pat. No. 4,807,879; U.S. Pat. No. 4,874,169; U.S. Pat. No. 4,497,492; and U.S. Pat. No. 3,671,040.

After careful review of the aforementioned prior art and the issued U.S. Pat. No. 5,072,947 it becomes evident that a variety of improvements are needed to overcome the game disadvantages which leave room fox a new and improved novel no bounce no dunk recreation ball game, in combination assembly.

SUMMARY OF THE INVENTION

The present invention relates to a recreational scoring game. The new novel foam ball game has holes punched throughout the entire playing ball in a symmetrical manner which yields an AIR drag so as to limit the hitting distance. This ball becomes easier to control,see and play in a defined playing area. At least two opposing players will hit the game ball across a court dividing net, which seperates each players court playing area. The virtical net is supported by an outlined frame of preferred P.V.C. pipe which is attached to and supported by posts at each end. The virtical net has no holes such as was in U.S. Pat. No. 5,072,947. Instead the net is used for advertising purposes such as displaying the name of the game. The ball striking instrument is a choice of wooden paddles, a racquet with strings therein or foam mitts wherein the players hands slid into. The game is played with both hands A second net assembly is placed on both side extending horizontally away from the virtical net in a downward position of 135 degrees from the top of the virtal net. This net returns the ball to the player that was unsuccessful is hitting the ball over the net to the opposite side. The game can be played in or outdoors. The game assembly has two,common to both sides, backboards. These are located one at each end of the virtical net above the virtical net assembly. Each has two basketball hoop and nets assemblies. One on each side of the virtical net. The approximate height and length of the basketball backboards is 24" by 54". These backboards are supported by P.V.C. pipe posts which interconnect with the frame of the game assembly. The backboard can be used to deflect the game ball,off the board and into the opposing court. Or shoot for a point by placing the game ball into your opponent net. The supporting posts may be sleeved so as to be lowered or raised for adult to children play.

In addition there is a common to both sides hoop and net assembly which is centrally located being attached to the P.V.C. pipe frame. This makes a total of five hoop and net assemblies in the game.

The game scoring points are achieved by placing the game ball in one of two nets located on your opponents side or in the common center net. The game has rules and regulations as does any other competitive sport. Points are also scored when;

(1) the ball goes out of bounds of the playing court;

(2) the ball hits the playing inbounds surface of the opposing player;

(3 the ball is played directly into the net or off the backboard into the net.

One novel part of the game is that each player may catch the ball on his/her racquet or mitt and bounce the game ball into the air and self-set themselves up thereafter placing an accurate shot to his/her opponents scoring assemblies which enables a point scored. In the case of of Doubles one partner may set up the other partner for the selected choice of scoring a point, similiar as to beach or indoor vollyball. At NO time can a player touch or block the game ball. Also at NO time can the ball bounce and then be played nor can a player grab the game ball and per say dunk the game ball. The game starts with 15 points with the first player or team to subtract points down to zero winning.

The balance of the features and advantages of this invention will be apparent during the course of the following drawings and preferred embodiment descriptions.

DESCRIPTION OF THE PREFERRED EMBODIMENT

Figure 1:
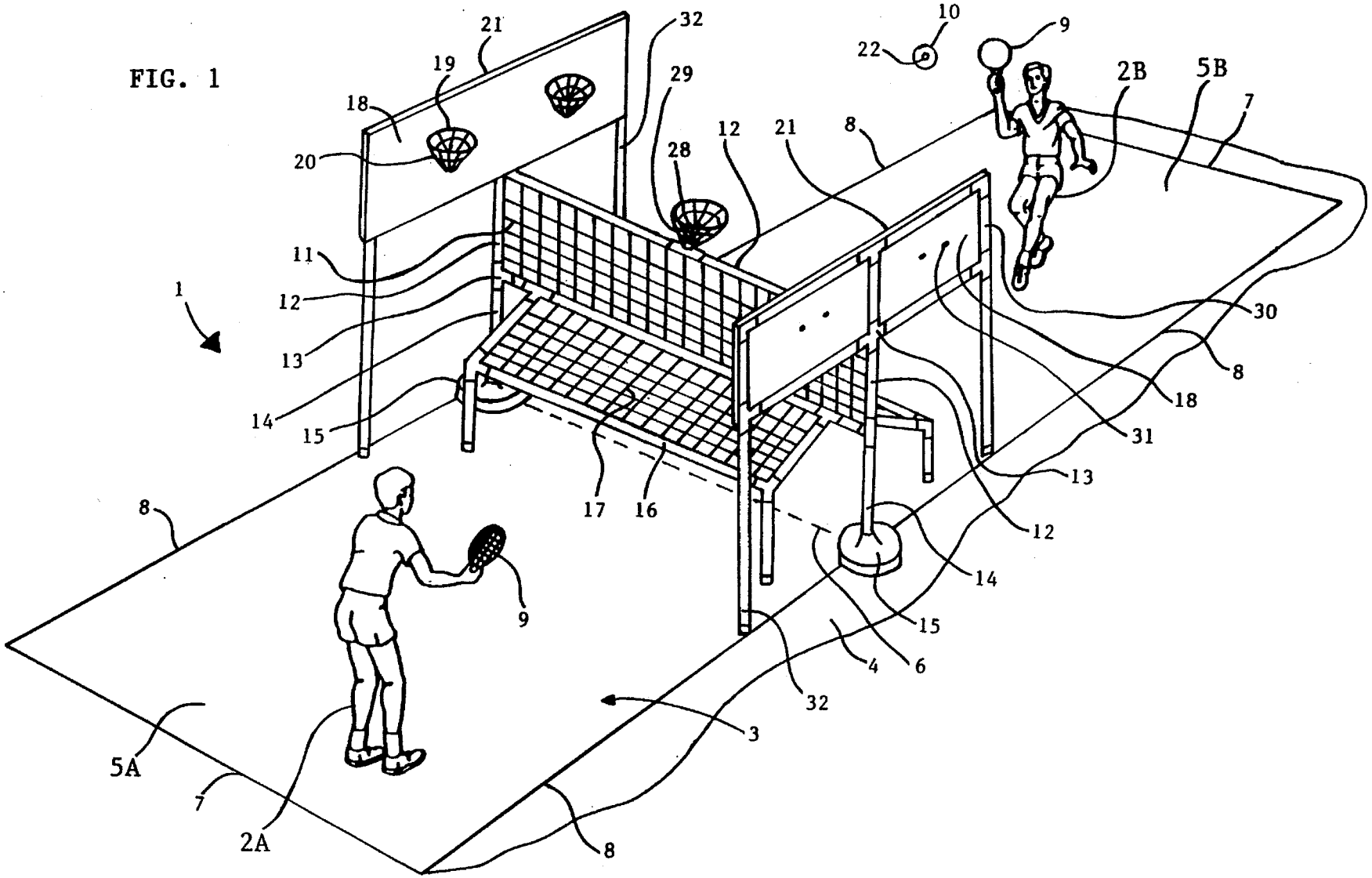
FIG. 1 is a pictorial perspective view illustrating the game of the invention.

Referring now to the drawings and especially to FIG. 1 thereof,the game of the invention is illustrated generally at 1 and is shown being played between two opposed players 2A and 2B on a court 3 of prescribed configuration and measurements. Court 3 extends along a horizontal playing surface 4 and includes first and second opposed playing areas 5A and 5B extending in opposite longitudinal directions from a central court position 6 lying equally between the playing areas 5A and 5B. Each playing area 5A abd 5B has a baseline 7 and opposite sidelines 8 extending from the central court position 6 to the corresponding baseline 7. Both sidelines 8 and both baselines 7 are parallel and are considered "OUT-OF-BOUNDS" lines for the court area 3.

Figure 9:
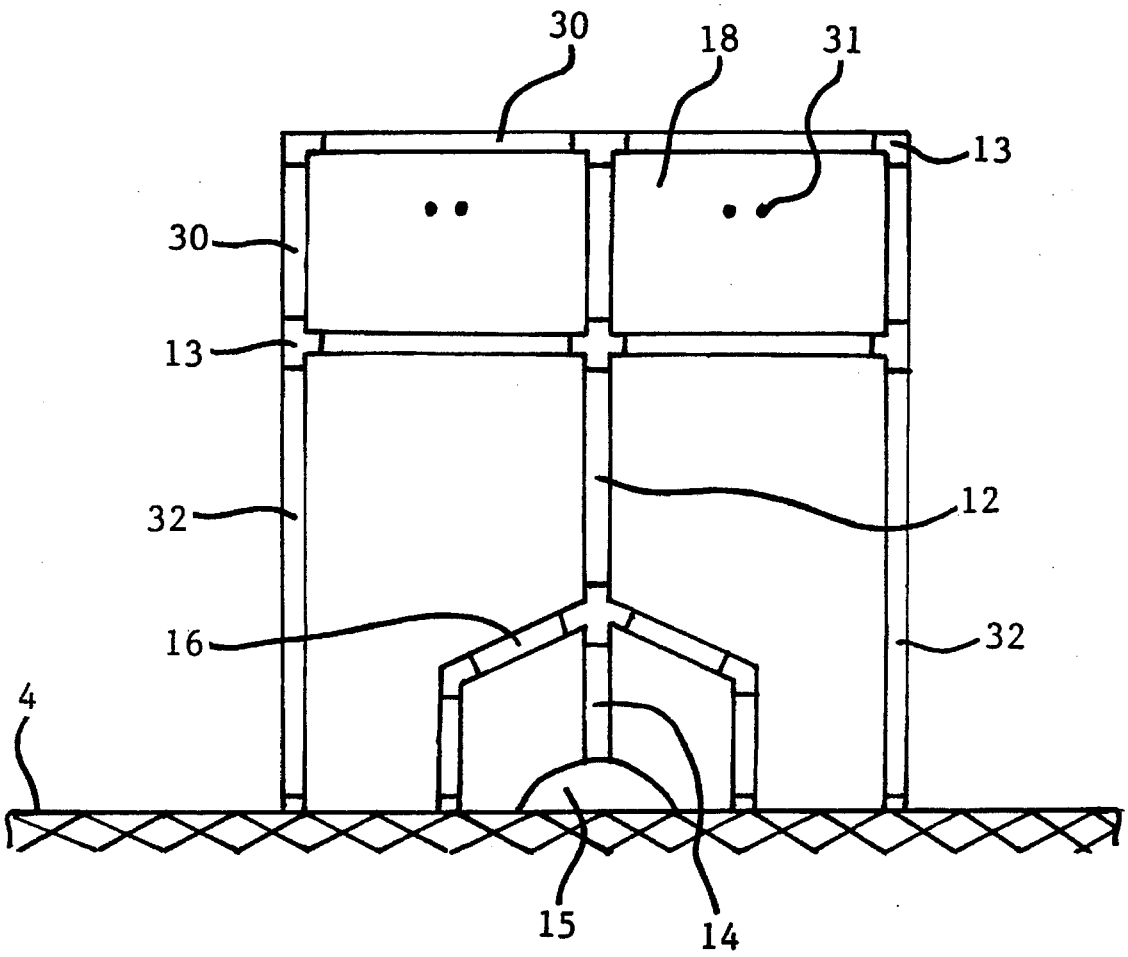
FIG. 9 is an outside elevationend view of the game apparatus.
Figure 10:
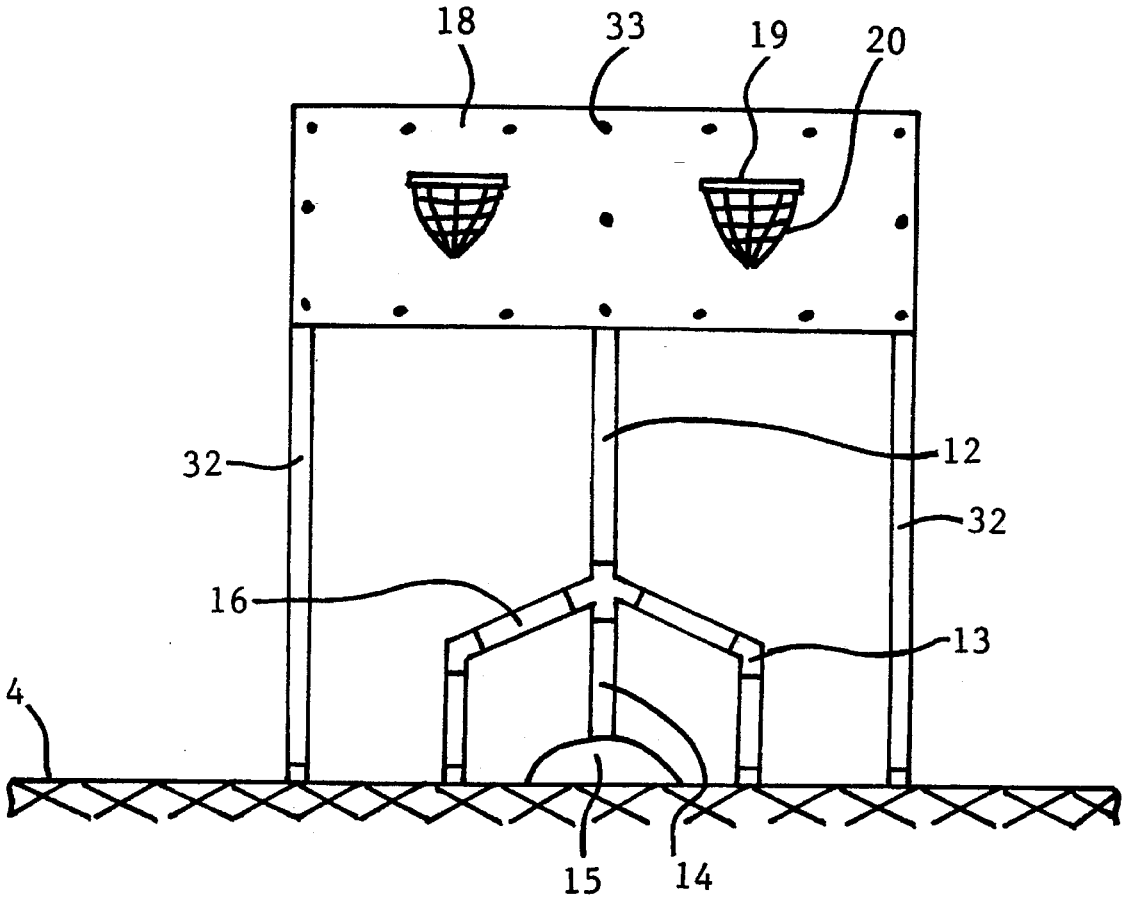
FIG.10 is an inside end elevation view of the game apparatus.

In FIG. 1, game 1 is shown being played by two opposed players 2A and 2B wherein each player is placed in a corresponding playing area 5A and 5B. Each player 2A abd 2B carries a paddle/racquet 9 for striking the game ball 11 with hole 22 therein. One player 2A, designated as the "server", stands behind the service line,also known as the baseline 7 and serves by hitting the ball 10 with the racquet/paddle 9 into the corresponding opposing playing area 5B so as player 5B may volley return the served ball 10. The second player 5B strikes the ball 10 with paddle/racquet 9 and returns the served ball 10 back into the opposing playing area 5A. The vertical net 11 is supported by the P.V.C. pipe support means 12 with fittings 13. At opposing ends of the vertical support net means 12 is an attached post 14 by fittings 13. Each post has a base 15 which supports the entire assembly 1. The indoor mode has a base 15 which allows the entire assembly to rest on a flat surface. In the indoor model the post 14 is pointed at one end so as to be pushed into the earth or sand. Attached to the bottom of the virtical net support means 12 by interconnecting fittings 13 is the return to player frame 16 with net mesh 17 which allows the game ball 10, when either player 2A or 2B misses the ball 10 , to come back to either player when they hit the virtical net 11 thereupon having failed to hit the game ball 1 to the opposing playing area. The return to player frame 16 with net 17 assembly is built at a 135 degree angled downwards as seen in FIGS. 9 and 10. The miss hit game ball 10 bounces off the virtical net 11 onto and off mesh 17 back to the player. Player 2A or 2B having miss hit the game ball 10 picks up the ball 10 and returns to the server line 7 and serves again or loses their serve for a side out.

A further point may be gained by either player 2A or 2B when the ball 10 hits the general court area 3 surface in the playing areas 5A or 5B. The "NO BOUNCE" rule applies to the game 1. A point is also received if either player 2A or 2B hits the ball 10 outside the court area 13 beyond either opposing baseline 7 or either opposing sideline 8.

At NO time can either player grab the game ball 10 and try to dunk the ball 10 into any one of the basketball hoop/net assemblies. Further points may also be scored by hitting ball 10 off either backboards 18. This deflection off the backboards 18 makes the game more interesting.

The overall basketball assembly 21 is positioned to extend into both sides of the virtical net 11 and game playing areas 5A and 5B. The game 1 has a backhand and forehand backboard or one at each end. Each backboard 18 has two hoop 19 net 20 assemblies attached to backboard 18 by screws/bolts 31. Each backboard 18 has a support means 3 which is P.V.C. pipe with interconnecting fittings 13. This assembly is supported by posts 32 and rests on playing surface 4.

Still further points may also be scored by hitting ball 10 off the backboards 18 through hoop 19 into attached net 20. The overall basketball assemblies 21 are positioned in opposing backhand and forehand sides within the general court area 3 for both playing areas 5A and 5B. Either opposing player 2A or 2B may score points.

Game 1 is played in a relatively small court which increases the necessity of quick response,touch and accuracy. The ball 10 with holes 22 throughout said ball 10 slow the ball 10 down to stay within a reasonable designated court area 3. Dimensions for a typical court 3 for singles, 1 on 1, or doubles, 2 on 2, includes 15 feet wide baseline 7 and 10 feet deep sidelines 8. Thereby forming playing areas 5A and 5B thus in the form of a rectangle. The base 15 for the indoor model is placed in a center court position 6 on the opposing side lines 8.

In singles, either player 2A or 2B may catch the ball 10 on the flat surface of the paddle or racquet 9 and immediately bounce ball 10 into the air to self-set thenselves up for a better shot in order to score a point. In doubles either partner 2A or 2B may set up each other to gain the advantage of a better position to enable a point scored.

Figure 7:
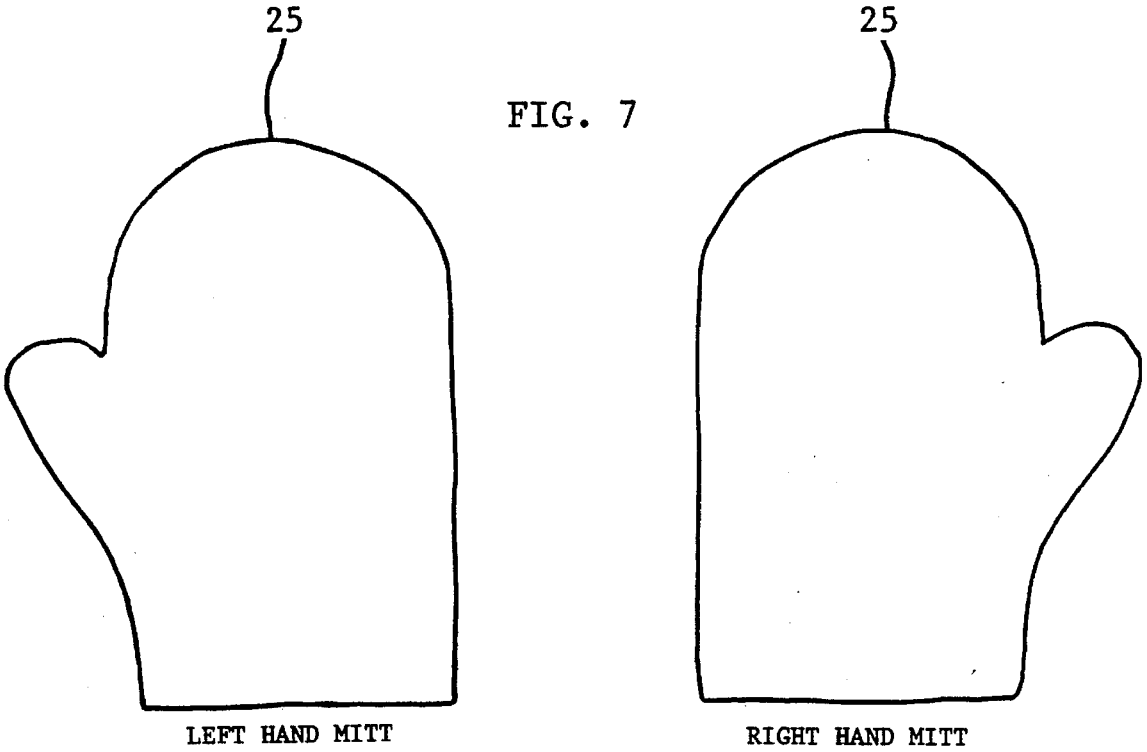
FIG. 7 is a flat/top view of the ball striking instrument,the mitts both the left and right hand.

Another ball striking instrument that may be used in the present invention is a set of foam mitts such as seen in FIG. 7. The mitts com as a set with one left hand and one right hand. The foam is heat sealed and dye cut to the correct shape and size from a polyester foam. These mitts make the game even more interesting and challenging with the use of both hands. It should also be noted that the game may also be played with two racquets or paddles. One in each hand.

Rules and regulations for the game are:

(1) No Bounce and No Dunk (2) Everytime the ball is served a point is scored.

(3) Both players start with 15 points. As a point is scored the player subtracts that point from 15. The first player to reach ZERO wins the game.

The dimensions and configuration of the court 3 may be varied to adjust for various levels of skill. Thus,it will be seen that game 1 requires only a small space for play. Also,since the ball 10 is not required to bounce from the playing surfaces 5A and 5B, when in play, the surface of the court 4 requires no special preparation or finish therefore game 1 may be played indoor or outdoors on a wide variety of playing surfaces 4.

Yet another way to score points in the present game 1 is a basketball assembly with only a hoop 28 and attached net 29 which is centrally located in the top of the support means 12 for the virtical net 11. This location is common to both opposed players 2A and 2B. Either player can score a point by placing the game ball 10 through the hoop 28 into attached net 29. Both opposed players 2A and 2B each have three nets to make use of for scoring points.

Figure 2:
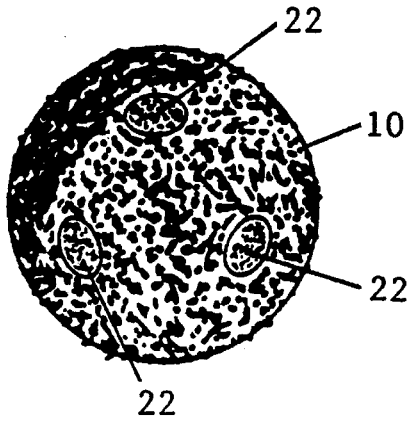
FIG. 2 is a pictorial view of the game ball.

Turning more to FIG. 2 the ball 10 of the invention is made of foam with a sperical aerodynamic designed shape. A plurality of holes 22 are cut into the foam ball by punching or drilling. The holes 22 go throughout the ball 10 from one surface to the opposite surface, as shown in more detail in FIG. 4. After several experiments the preferred combination is three identical holes 22 geographically located at starting entrance 23 position while passing entirely through ball 10 to an exit point 24 on the opposite surface. Each hole 22 is preferred round in shape.

The amount of the foam ball 10 material removed may range from 4% to 55% by weight/volume. Preferred is approximately 20% by weight/volume removed from the ball 10. If any less, the ball 10 has less air drag. If any more, the ball 10 will collapse. making the ball unplayable. Twenty percent removed yields a stable playable ball 10 with just enough air drag to limit the distance for playability in the game 1 of the invention.

The ball is manufactured from a polyurethane open cell foam. Preferred is polyether which passes the U.S.A. Federal Safe Toy Act.

The preferred ball 10 diameter is four inches. The right size to handle while fitting through most basketball hoop/rims 19. The pore size of the ball 10 may range from 10 to 100 p.p.i.'s (pores per inch) Preferred is approximately 50 p.p.i.'s. The color of ball 10 may range from a spectrum from white to black.

Figure 3:
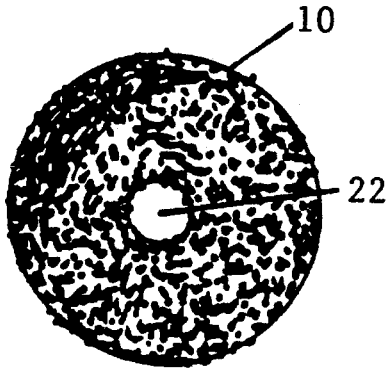
FIG. 3 is a front view,of one side,of the game ball.

In FIG. 3 the ball 10 is shown from a front view with hole 22 entrance located in the center.

Figure 4:
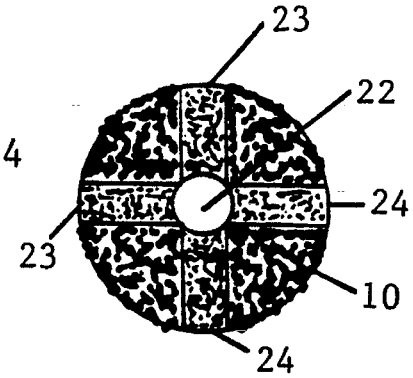
FIG. 4 is a cross sectional view of the game ball.

In FIG. 4 the cross sectional view of the ball 10 reveals a center hole 22 intersected by the cut hole channels entering at 23 and exiting at 24. This view reveals three holes 22 in ball 10.

Figure 5:
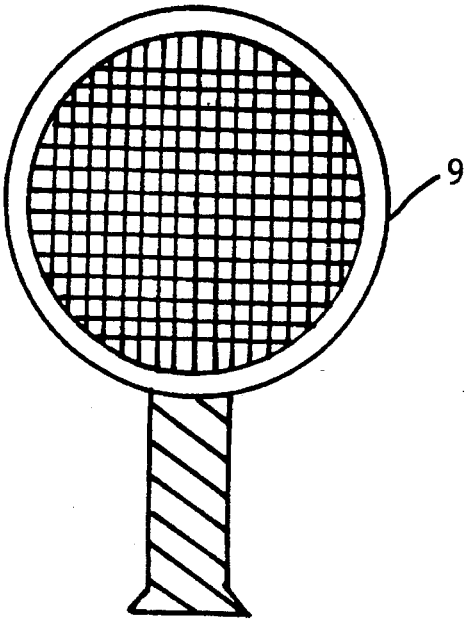
FIG. 5 is a flat/top view of the ball striking instrument,a racquet.

In FIG. 5 the flat view is of the ball striking instrument a racquet with a handle and strings.

Figure 6:
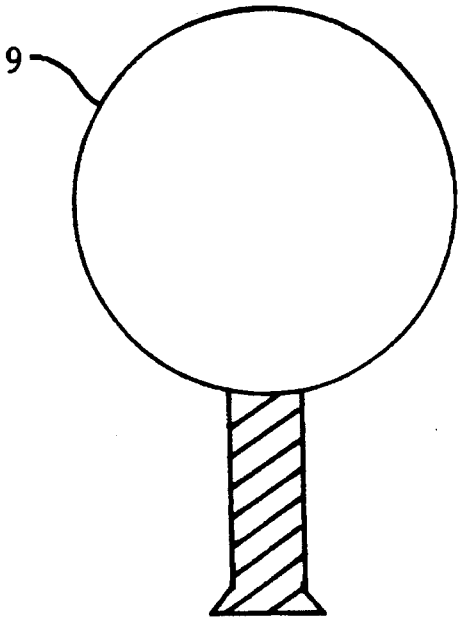
FIG. 6 is a flat/top view of the ball striking instrument,a wood paddle.

In FIG. 6 the flat view is of the paddle 9 also one of the ball striking instruments.

In FIG. 7 the flat view is of the mitts 25 both the right and left hand model. These mitts come in two basic sizes adult and children. The mitts 25 may also come in a variety of colors.

Figure 8:
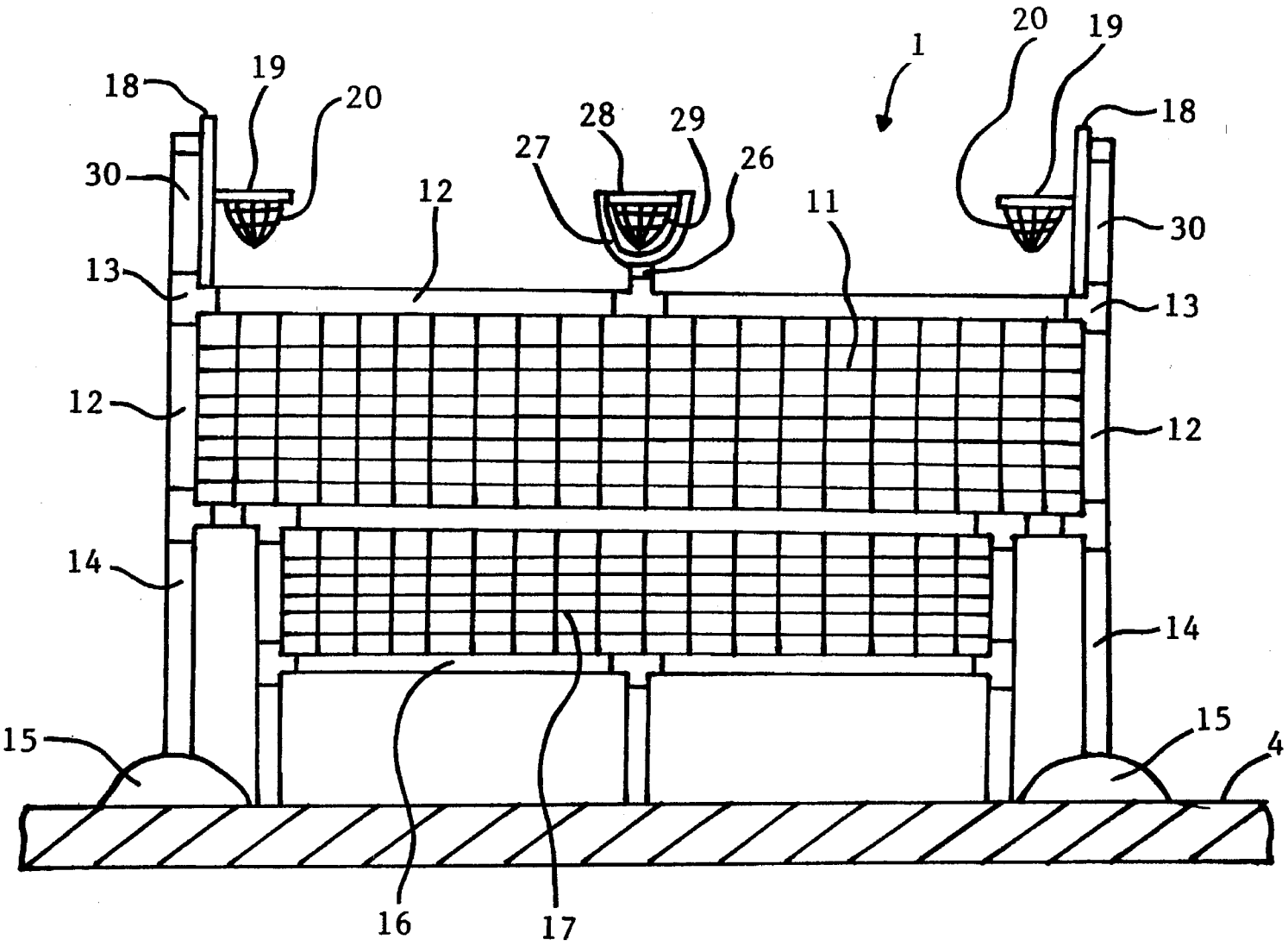
FIG. 8 is a front elevation view of the game apparatus.

In FIG. 8 a front elevated view of the game 1 of the invention is shown with two opposing posts 14 bases 15 on a playing surface 4 which support the virtical net frame 6 with interconnecting P.V.C. fittings 13 with attached vertical mesh net 11. Attached to the top of the virtical net 12, in the middle, by attachment means 26 is the hoop support 27 with attached hoop 28 and net 29. At each end of the vertical net support means 12 is a backboard 18 with hoop 19 and net 20. This assembly is supported by means 30 a P.V.C. pipe frame interconnected to virtical net support means 12 by fittings 13. This backboard is approimately 24 inches high by 54 inches wide. The backboard 18 is attached to the P.V.C. pipe frame by screws or bolts.

Further in FIG. 8 is the return to player frame 16 with attached net 17 which is interconnected to the bottom portion of the virtical net support means 12 by fittings 13. The return to player assembly has built-in legs to help support itself.

In FIG. 9, an outside end elevated view is shown with the assembly sitting on playing surface 4 supported by posts 12 interconnected by fittings 13 and a backboard frame 30 with attached backboard 18 while supported by posts 32. The hoop and net are not shown in this diagram but the attachment means 31 for the hoop/net assemblies is shown on both sides. The frame means 16 for the return to player assembly is shown connected to the lower portion of the virtical net support means 12. Post 14 is shown along with base 15 which are both extensions of support means 12. The support means 12 extends out from means 12 in a downward angle of approximately 135 degrees from the top of support means 12. This gives a good angle for the game ball to deflect off the virtical net onto the return to player net thereby returning to the player so they are not chasing the ball.

In FIG. 10. an inside end elevated view is shown with the assembly sitting on playing surface 4 supported by post 14 interconnected by fittings 13 with a backboard 18 and attachment screws/bolts 33. Attached to the backboard 18 are two hoop 19 with net 20 assemblies. The backboard 18 with assembly is supported by posts 32. The backboard 18 assembly is also supported by the interconnected virtical net support means 12 with post 14 base 15 and fittings 13.

Figure 11:
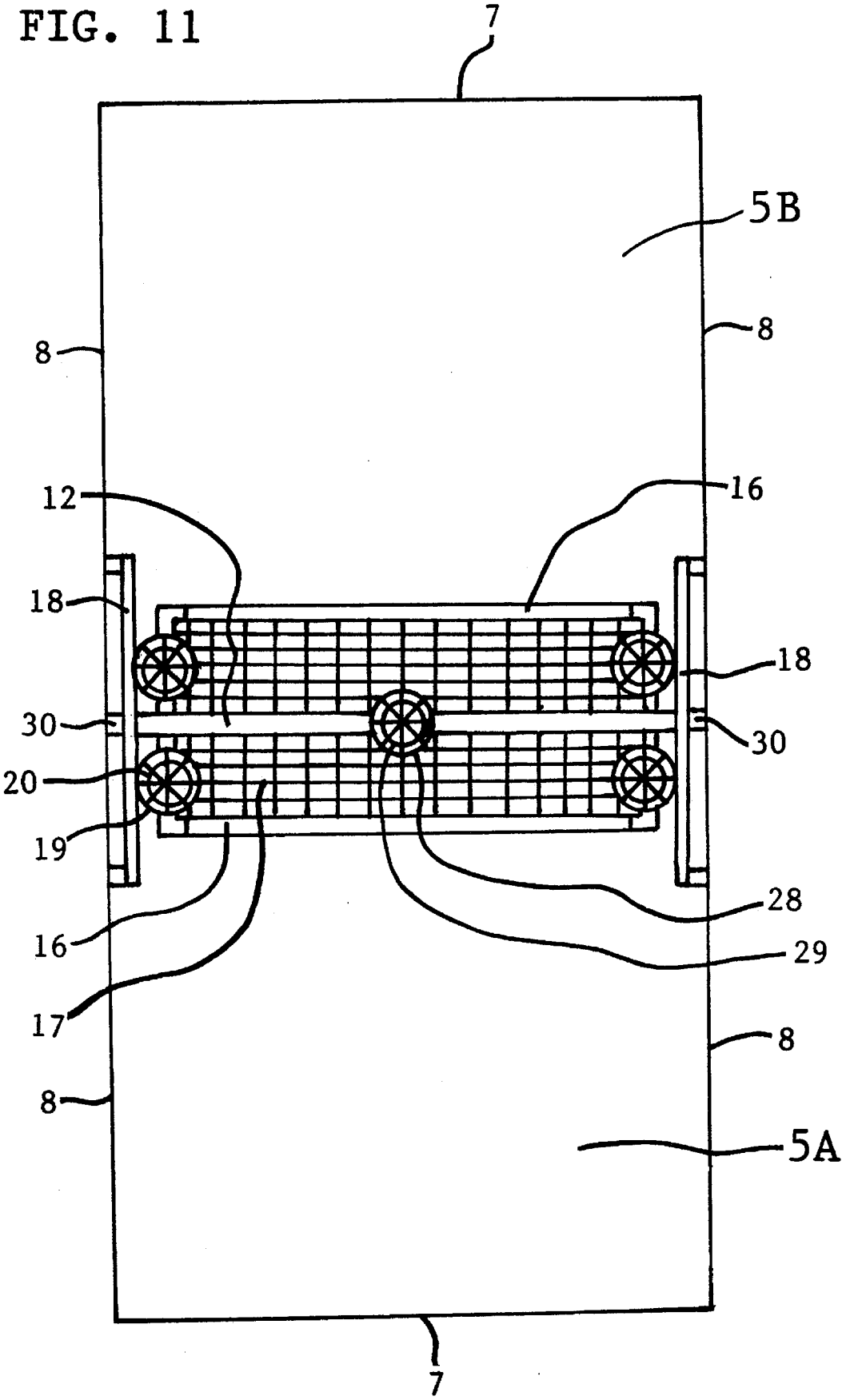
FIG.11 is a top plan view of the game apparatus used in playing the invention.

FIG. 11 is a top plan view of the game 1 of the invention wherein court playing areas 5A and 5B are seperated by a frame structure 12 with a centrally located hoop 28 net 29 assembly. At each end is a backboard 18 with support means 30 and attached to both backboards 18 are a total of four hoop 19 net 20 assemblies. On each opposing side of vertical net support means 12 is a return to player frame 16 with attached net 17. The entire court area has opposing parallel base lines 7 and opposing parallel side lines 8.

As to the preferred manufactured apparatus of the game 1 of the aforementioned invention with the game ball 10; select the desired foam,shape,diameter size with the number of holes 22 and position of holes 22 and manufacture said game ball 10. For the game 1 apparatus select the preferred ball striking instrument a racquet, a paddle or mitts, for singles or doubles play, in combination with a frame style, a post style, a net style, a return to player net style and construct the game 1 apparatus for in-outdoor use with desired court size along with the game rules and regulation and play the game 1 of the invention.

Further mention is herein mentioned about the material selected for the nets. The best all around material is the cushion covering material used in the outdoor P.V.C. furniture business. This material is strong will not mildew with outdoor use, will not rip or tear, sews easily and can be cut to fit easily. A wide selection of colors is also available.

It is hereby understood that the aforemnetioned detailed form of the preferred embodiment of the invention is not to be limited to the exact arrangement but is an example only. The arrangement of the parts shown in the drawings or described in the disclosure may be modified without departing from the true spirit and scope of the invention. The details of the shape,size,materials and function of the game of the invention are of novel concept thereof.

Having thus described the invention with an exclusive property or privilege:

What is claimed is:

1. A competitive no bounce no dunk recreational ball game assembly in which opposed players return a ball within a prescribed court extending along a horizontal playing surface in opposite longitudinal directions from an apparatus located on the playing surface between the players such that the court is divided into first and second opposed playing areas with the apparatus placed therebetween, the ball game assembly comprising in combination:

rules and regulations for scoring points to win said game;

at least one game ball;

at least one ball striking instrument;

and an apparatus,said apparatus comprising:

a frame having a first angular supporting means for supporting a return to player net in an angular downward position, a second vertical supporting means connected to said angular supporting means for supporting another net in a vertical position above said. angular net wherein the angular and virtical nets form 135 degree downward angles on either side of said vertical net, a plurality of supporting stands, each stand connected to and extending downwardly form an opposite lateral edge of said angular supporting means for supporting said apparatus on a playing surface, a plurality of third supporting means extending downwardly to the playing surface and connected to said vertical supporting means, each third supporting means supporting a common to both opposed players basketball backboard, with at least one hoop and net assembly, said hoop and net dimensioned for said ball, driven by said striking instrument to pass therethrough, each basketball assembly positioned on opposite ends of said virtical net at right angles and above said horizontal net, said game ball being deflectable off said backboards into either opposed playing areas, said vertical frame acts as a fourth supporting means for a common to opposed sides hoop and net assembly positioned in and connected to the center of the top portion of said vertical supporting means.

2. The invention of claim 1 wherein said game ball is made of polyurethane foam having open cells said ball being printable thereon.

3. The invention of claim 2 wherein said game ball comprises a plurality of holes formed therethrough wherein the amount of foam material removed to form said holes ranges from 4% to 55% of the weight volume of said original foam material forming said game ball.

4. The invention of claim 3 wherein the holes of said game ball intersect in the center of said ball forming a central cavity in said ball thereby allowing air to pass throughout said ball when struck by the game ball striking instrument.

5. The invention of claim 1 wherein said rules and regulations for scoring points begins at 15 and for each point scored a point is subtracted from 15 so the first player to zero wins said game while everytime said game ball is served a point is scored.

6. The invention of claim 1 wherein said ball striking instrument is a foam mitt formed with an upper and lower layer of said foam which has been heat sealed and dye cut to shape said mitt said mitt being printable thereon.

7. The invention of claim 1 wherein said ball game has a no bounce and a no dunking rule as part of rules and regulations of said game.

8. The invention of claim 1 wherein each opposing player uses a ball striking instrument in or on their right and left hand to play said game, thereby using either hand related striking instrument, to strike said game ball.

9. The invention of claim 1 wherein there are a total of five said basketball hoop and net combination assemblies;

two said assemblies on one side of said virtical net;

two said assemblies on the opposite side of said virtical net; and a single said assembly being centrally located and common to both opposing sides thereby said assemblies yield five different locations of scoring points in said ball game.

* * * * *